US008763483B2

(12) United States Patent
Heinrichs

(10) Patent No.: US 8,763,483 B2
(45) **Date of Patent: *Jul. 1, 2014**

(54) DUAL ELECTROMOTIVE FURNITURE DRIVE

(75) Inventor: Andreas Heinrichs, Vlotho (DE)

(73) Assignee: DewertOkin GmbH, Kirchlengern (DE)

( * ) Notice: Subject to any disclaimer, the term of this patent is extended or adjusted under 35 U.S.C. 154(b) by 721 days.

This patent is subject to a terminal disclaimer.

(21) Appl. No.: 12/747,579

(22) PCT Filed: Dec. 4, 2008

(86) PCT No.: PCT/EP2008/066789

§ 371 (c)(1),
(2), (4) Date: Sep. 7, 2010

(87) PCT Pub. No.: WO2009/074505

PCT Pub. Date: Jun. 18, 2009

(65) Prior Publication Data

US 2011/0025150 A1 Feb. 3, 2011

(30) Foreign Application Priority Data

Dec. 13, 2007 (DE) ..... 20 2007 017 534 U

(51) Int. Cl.
*F16H 27/02* (2006.01)
*A47C 20/04* (2006.01)

(52) U.S. Cl.
CPC ..... *A47C 20/041* (2013.01); *A47C 20/042* (2013.01)
USPC ..... 74/89.23; 74/89.37; 318/7

(58) Field of Classification Search
CPC ..... A47C 20/041; A47C 20/042
USPC ..... 74/89.23, 89.37; 5/618; 200/47; 318/7, 318/466, 467, 432, 560
See application file for complete search history.

(56) References Cited

U.S. PATENT DOCUMENTS 5,675,849 A * 10/1997 Koch ..... 5/616
5,890,585 A * 4/1999 Nakamura et al. ..... 200/47

(Continued)

FOREIGN PATENT DOCUMENTS

DE 201 15 507 U1 12/2001
DE 201 06 189 U1 2/2002

(Continued)

OTHER PUBLICATIONS

EPO Translation of Abstract, Description, and Claims of DE 10 2004 023 243 A1, Frank et al., Dec. 1, 2005.*

*Primary Examiner* — Vinh Luong
(74) *Attorney, Agent, or Firm* — Henry M. Feiereisen LLC

(57) ABSTRACT

A dual electromotive furniture drive has a housing with a drive motor, which is drive-coupled to a rotation speed reduction gear mechanism, which moves rotation-locked spindles longitudinally, wherein the rotation speed reduction gear mechanism and the spindles are arranged in the housing. An end switch limits the end positions of the spindles. A pressure piece is arranged on the spindles on the side facing away from the rotation speed reduction gear mechanism. The pressure piece is operatively connected to an adjusting element which is fixedly mounted on a moving furniture component. The spindles are inclined relative to the horizontal at an obtuse angle. The dual electromotive furniture drive is configured to adjust the back rest and/or the foot rest of a slatted frame. This design has a low parts count, and optimally transfers the internal forces, in particular through the housing walls.

9 Claims, 3 Drawing Sheets

(56) References Cited

U.S. PATENT DOCUMENTS

| | | | | |
|---|---|---|---|---|
| 6,269,707 | B1 * | 8/2001 | Koch | 74/89.23 |
| 7,262,377 | B1 * | 8/2007 | Wei et al. | 200/47 |
| 7,596,820 | B2 * | 10/2009 | Nielsen et al. | 5/618 |
| 8,201,468 | B2 * | 6/2012 | Heinrichs | 74/89.23 |
| 2004/0020316 | A1 * | 2/2004 | Dewert | 74/89.23 |
| 2006/0130236 | A1 * | 6/2006 | Dewert et al. | 5/616 |

FOREIGN PATENT DOCUMENTS

| | | | | |
|---|---|---|---|---|
| DE | 10 2004 023 243 | A1 * | 12/2005 | H02K 7/06 |
| EP | 1 378 189 | A | 1/2004 | |
| EP | 1 900 309 | A | 3/2008 | |

* cited by examiner

DUAL ELECTROMOTIVE FURNITURE DRIVE

CROSS-REFERENCES TO RELATED APPLICATIONS

This application is the U.S. National Stage of International Application No. PCT/EP2008/066789, filed Dec. 4, 2008, which designated the United States and has been published as International Publication No. WO 2009/074505 and which claims the priority of German Patent Application, Serial No. 20 2007 017 534.5, filed Dec. 13, 2007, pursuant to 35 U.S.C. 119(a)-(d).

BACKGROUND OF THE INVENTION

The invention relates to a dual electromotive furniture drive with a housing, wherein the housing is constructed in at least two sections and has U-shaped openings, in which shafts, which are pivotable relative to the housing and operatively connected with at least one furniture component to be adjusted, engage, wherein the U-shaped openings have covers which can be installed formfittingly and preferably in the longitudinal direction of the shafts and which are connected with the housing for fixing the position of the shafts, wherein the dual furniture drive is provided with at least one drive motor, which is drive-coupled to a rotation speed reduction gear, and wherein a spindle which is secured against rotation can be moved in its longitudinal direction by the rotation speed reduction gear, and wherein at least the rotation speed reduction gear and the spindle are arranged inside the housing, and wherein the end positions of each spindle are limited by at least one end switch.

Two embodiments of the aforementioned dual electromotive furniture drives are known. According to a first embodiment, the dual drive is provided is provided with two drive motors which are arranged on the side of the housing in motor pots. The dual furniture drive, hereinafter referred to only as dual drive, is provided with two rotation speed reduction gears which are each drive-coupled with a corresponding drive motor. A spindle on which a rotation-locked spindle nut is placed is fixedly connected with the driven member of each rotation speed reduction gear in one-to-one correspondence. This spindle nut forms the driven member of each drive train of the dual drive; for example, a connected furniture component is adjusted by way of a lifting tube fixedly placed on the spindle nut.

According to a second embodiment, the dual drive is provided with a drive motor and a rotation speed reduction gear. This rotation speed reduction gear is designed to allow movement of a rotation-locked spindle in the longitudinal direction. This spindle then forms the driven member of the dual drive. The two end faces can be drive-coupled with components to be adjusted, depending on the movement direction of the spindle.

The end switches are inserted into a so-called end switch strip having a U-shaped cross-section. The center leg of this end switch strip is provided with a row of holes, so that at the end switches can be placed at different positions in the end switch strip. The last-mentioned embodiment has proven useful, but disadvantageously requires a relatively high number of components for operating the furniture drive.

It is an object of the invention to construct an electromotive dual furniture drive of the aforedescribed type which minimizes the number of components, which is simple and easy to install, which can be produced with less material by optimizing interior force transmission, and the paths for force transmission through the walls of the housing are kept short, while still being safe to operate.

SUMMARY OF THE INVENTION

The object is solved by fixedly installing on the side of the spindle facing away from the rotation speed reduction gear a pressure piece which is operatively connected to an adjusting element that is fixedly attached on a movable furniture component.

The driven member of the rotation speed reduction gear is configured as a rotational body and has an interior thread which engages with the exterior thread of the spindle. Because the pressure piece can be made very short, it can be moved in the first end position setting close to the rotation speed reduction gear, so that the motor with the attached rotation speed reduction gear can be arranged with a smallest possible distance to the adjusting element of the movable furniture component, thus allowing the large adjusting forces to be absorbed by a relatively small housing region of the housing walls. Because a relatively large hollow space is here formed in the housing between the motors, a corresponding electric control of the motors can be installed in this space.

The pressure piece produces an adequate contact surface between the adjusting element and the driven element of the dual furniture drive. The adjusting element is, when the dual drive is used for a slatted frame, an adjusting lever which is fixedly placed on the shafts of the back portion or the foot portion.

The adjusting element configured as a lever has in many applications an angled shape. In order to transfer the greatest possible force from the driven element of the dual drive to the lever at least at the beginning of the adjustment motion, the spindle is inclined with respect to the horizontal in relation to the installation position of the dual furniture drive, and a second spindle is preferably likewise inclined in relation to the installation position of the dual furniture drive in such a way that the center longitudinal axes of the spindles enclose an obtuse angle. A force extending in the direction of the center longitudinal axis of spindle is thereby transmitted to the adjusting element at the beginning of the adjusting motion. According to one embodiment, both spindles of the dual drive are configured to be inclined with respect to the horizontal, wherein the center longitudinal axes of the spindles enclose an obtuse angle, for example an angle of 170°. The forces passing through the housing walls are thereby optimized such that the holding forces applied on the covers are reduced, which also reduces the material requirements for the housing components.

A particularly simple manufacture and hence also low-cost production is made possible by implementing the block-like pressure piece as a hollow body, because this produces an embodiment with reduced material consumption. In a preferred embodiment, the block-like pressure piece is made of a suitable plastic.

Because the dual furniture drive is preferably employed in a home setting, provisions are made for reducing the noise generated during adjustment by at least partially enclosing at least the rotation speed reduction gear with a damping body, or by attaching the damping body to the rotation speed reduction gear. This dampens the so-called structure-borne noise, which is only minimally transmitted from the noise-generating motor to the housing.

Because the adjusting speed of the furniture components to be adjusted is relatively low, the rotation speed reduction gear may be configured as a worm gear which is connected with a rotation-lock to at least one nut, wherein the threads of the nut engage with the threads of the spindle, or wherein the nut together with the worm wheel forms a single shaped part. The linear speed of the spindle is minimized by using a worm wheel when the drive motor is switched on. The worm wheel and the nut are advantageously made of plastic, preferably of POM. To minimize the width of the housing and to also minimize the material requirements, the drive motor may be inserted in a motor pot, which is flanged externally on a side wall of the housing or is formed as a single piece with the housing.

It is also considered disadvantageous for furniture drives that the housing must be opened for adjusting the end switches and making the end switches accessible. However, the positions of the end switches depend on the travel of the furniture component to be adjusted. Although this manner for adjusting the end switches has met with some success, users of dual drives find this unsatisfactory, because it cannot be judged from the outside how the end positions of the driven members of a furniture drive are to be set.

For solving this problem, the driven element and/or the housing are provided with an adjusting device, with which the position of the switching threshold of the at least one end switch can be adjusted from outside the housing.

The wall of the housing associated with the adjusting device is also provided with an opening through which an actuating element of the adjusting device can be guided. The adjusting device is then coupled with the switching threshold of the at least one end switch in such a way that the respective switching threshold of the at least one end switch with respect to the rotation speed reduction gear can be set at different intervals.

The end switch can now be moved from the outside without disassembling the dual furniture drive, because the end switch receptacle, for example implemented as a housing-like end switch receptacle, is designed such that a displacement or a setting may be provided by suitable handling, whereby the position of the end switch receptacle and hence also of the end switch is secured following the displacement.

According to a preferred embodiment, at least one end switch is inserted in a housing-like end switch receptacle, and an associated wall of the housing is provided in a region abutting the end switch receptacle with a slot forming an opening, wherein the end switch receptacle can be secured in the slot in relation to the rotation speed reduction gear at different intervals.

According to a first embodiment, the driven element and/or the housing include an adjusting device, and the wall of the housing associated with the adjusting device includes an opening, wherein the adjusting device is coupled with the switching threshold of the at least one end switch in such a way, that the respective switching threshold of the at least one end switch can be secured in relation to the rotation speed reduction gear at different intervals. This approach allows to arrange the at least one end switch on the driven element or on a component moving in conjunction with the driven element.

According to another embodiment, each end switch receptacle is displaceably guided in a guide abutting the wall of the housing. The position of each end switch is thereby exactly fixed, preventing cocking or jamming during displacement of the end switch receptacle.

According to another embodiment, the marginal regions delimiting each slot in the wall of the housing have profiles, and the end switch receptacle is provided with at least one corresponding counter-profile. In this way, the end switch receptacle and hence also the end switch are secured against unintentional movement. These corresponding profiles can also be viewed as latching means.

According to another embodiment, the end switch receptacle includes a flexible leaf or a flexible tongue, which is provided with the counter-profile and engages with the profiles of the marginal regions delimiting the slot, and which is elastically deformable by the applied force allowing the profiles to disengage. When the profiles are disengaged, the end switch receptacle can be moved in the longitudinal direction of the spindle. With this configuration, the end switch receptacle can be moved without using a tool, by deforming the flexible leaf or the flexible tongue by using a finger.

For actuating the end switch(es), a draw rod which follows the linear movement of the spindle is provided inside the housing of the dual drive. This draw rod is arranged and configured so that the furniture component that can be adjusted with the movable spindle remains in the respective end position by switching off the drive motor.

In a preferred embodiment, the draw rod is configured as a flat rod with at least one longitudinal groove in which a guide web of the end switch receptacle engages. The cooperation between the longitudinal groove and the guide web ensures that the draw rod is in the proper position relative to the respective end switch, so that the tappets are fully operated for switching. To ensure a gentle operation of the tappets, the draw rod may have an inclined surface, which forms the stop face, on the free end facing the respective end switch.

Many applications use a dual drive for adjusting the adjustable parts of a lattice frame. A so-called articulated lever is placed with a rotation-lock on the adjustment chassis for the back rest and the foot rest. To ensure continuous contact between the free end region of the articulated lever and the driven element of the furniture drive, a block-like slider is fixedly attached at the end of the spindle facing away from the reducing gear. This slider can be constructed as a hollow body to save material, wherein the slider and/or the spindle form the driven element. In a preferred embodiment, the draw rod is attached on the hollow body or on the driven element and is spaced from the spindle. Alternatively, the draw rod may be secured on one or several turns of the thread facing away from the reducing gear.

To allow the user of the furniture drive to identify the maximum travel of the spindle, a graduation may be arranged on the outside on the housing adjacent to the slot. The graduation may indicate the traveled distance, for example in form of numbers, thereby facilitating adjustment for the user.

According to another embodiment, the driven element and/or the housing include an adjusting device which can be formed by a movable end switch receptacle.

The adjusting device may be adjusted either directly manually or by using a tool. To this end, the wall of the housing has in the region of the adjusting device a slot, an opening or a segment forming a slot or an opening, so that the adjusting device can be moved from outside the housing along a slot, or can be located in a bore.

The adjusting device may be freely accessible from the outside of the housing or may be covered by a cover in order to prevent, for example, moisture from entering the interior of the housing. But adjusting the at least one adjusting device, at east a distance between a stop face and an end switch or a tappet actuator of an end switch is adjusted and secured in place after adjustment. The tappet actuator or the end switch has during actuation by the stop face a switching threshold which switches the at least one switching contact of the end switch. With this arrangement, the switching threshold of the at least one end switch is coupled to the adjusting device in such a way that the corresponding switching threshold of the at least one end switch with respect to the rotation speed reducing gear can be set at different intervals.

According to this exemplary embodiment, the distance between the stop face and the end switch, which switches the electric motor in the fully actuated position or in the fully extended position of the furniture component off, is adjusted. The maximal travel of the connected furniture component can thereby be adjusted, thus limiting the lift of, for example, the head section or the foot section of a lattice frame.

According to another embodiment, at least one end switch is coupled to or fixedly connected with at least one adjusting device. According to another embodiment, the tappet of the at least one end switch is coupled to or fixedly connected with at least one adjusting device. According to still another embodiment, the stop face for actuating the end switch is coupled to or fixedly connected with at least one adjusting device. According to another embodiment, the linearly movable driven element, for example implemented as a spindle or a movable, yet rotation-locked slider or a draw rod, are coupled to or fixedly connected with at least one adjusting device. According to a particular embodiment, an embodiment is realized from the combination of the aforedescribed embodiments.

In one embodiment, the adjusting device is formed by an end switch receptacle with formfittingly latching positions. Other embodiments may include clamping screws or adjusting screws, so that a continuous adjusting device can be constructed. As at least described above, the adjusting device may be integrated on or inside the housing of the dual drive, attached hereto or inserted therein. According to other embodiments, the adjusting device may also be attached, inserted in or coupled with the driven element. According to another embodiment, the at least one end switch is placed on a printed circuit board, on which additional control elements for controlling the at least one electric motor are placed, for example in form of branch lines, electric terminals or in form of electromechanical switches. According to this embodiment, at least one end switch associated with the printed circuit board is coupled to or fixedly connected with at least one adjusting device.

BRIEF DESCRIPTION OF THE DRAWING

The invention will now be described in more detail with reference to the appended drawings.

These show in.

DETAILED DESCRIPTION OF PREFERRED EMBODIMENTS

Figure 1:
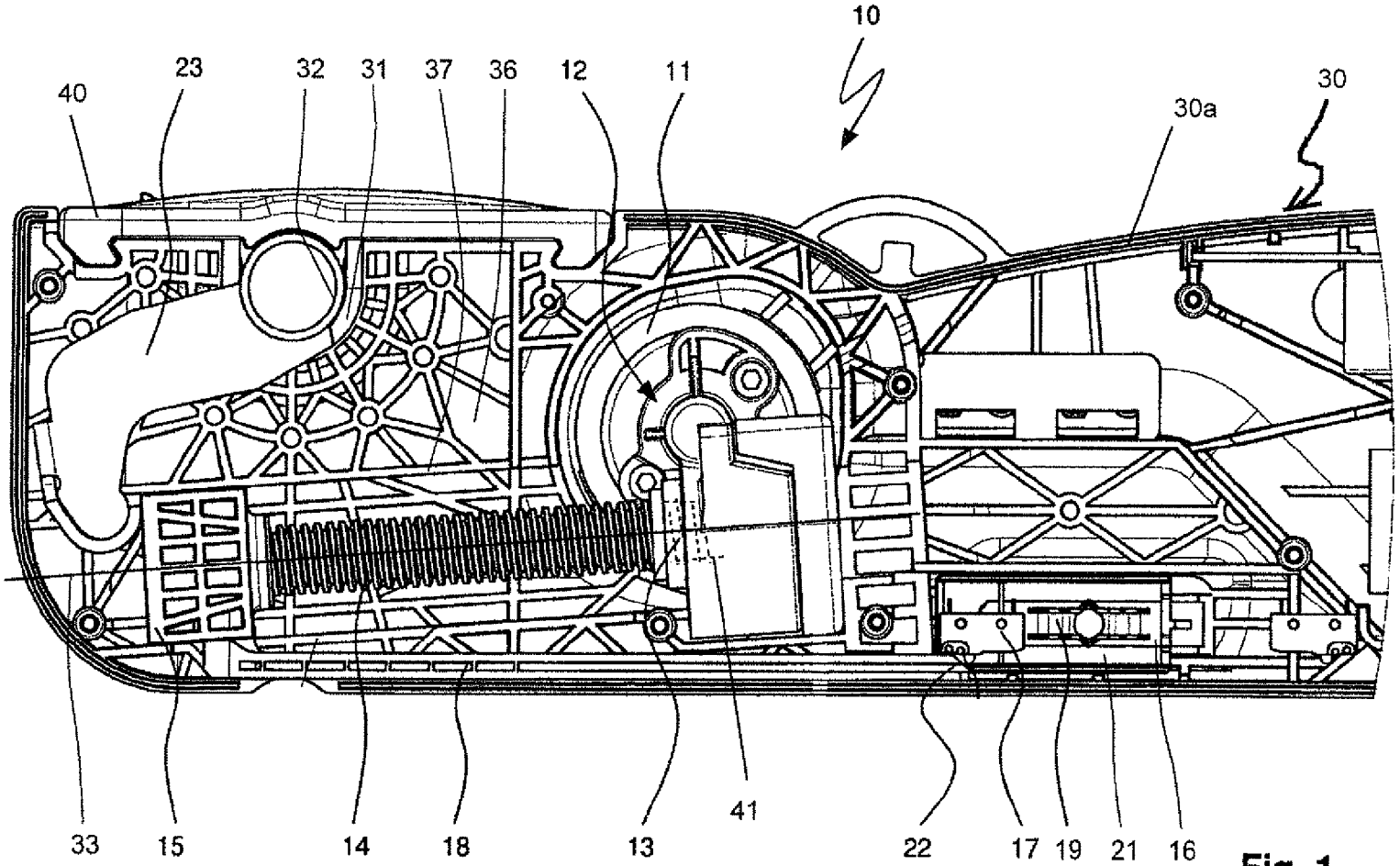
FIG. 1 a simplified schematic diagram of an exemplary embodiment of a dual furniture drive according to the invention, FIG. 2 a partial view of the housing of the dual furniture drive, FIG. 3 a single unit showing the end switch receptacle in a perspective view, and FIG. 4 a schematic diagram of a dual furniture drive according to the invention.

FIG. 1 illustrates in a sectional view one drive 10 of a dual furniture drive with a housing 30 constructed in at least two housing sections 30*a* (only a rear section 30*a* is shown) and an electromotive drive motor 11 and a rotation speed reduction gear 12. Dual furniture drives are generally known in the art, for example from DE 201 06 189 U1. The housing has U-shaped openings 31 in which shafts 32 engage which are pivotable relative to the housing 30. The rotation speed reduction gear 12 includes a worm and a meshing worm wheel which is fixedly connected with a drive nut 13 with an interior thread 41. Different from this illustration, the bore of the worm wheel could also be constructed as a bore with an interior thread. In the illustrated exemplary embodiment, the drive nut 13 is connected with a spindle 14 with a rotation-lock. If this drive nut 13 were omitted, then the spindle 14 would be inserted with a rotation-lock into the interior thread bore of the worm wheel. As seen in FIG. 1, the rotation-locked spindle 14 moves along its longitudinal direction when the drive motor is switched on, whereby the travel direction depends on the rotation direction of the worm wheel.

In the illustrated exemplary embodiment, a block-like slider 15 configured as a hollow body is fixedly placed on the end of the spindle 14 facing away from the rotation speed reduction gear 12. This block-like slider 15 cooperates with an articulated lever 23 which is placed with a rotation-lock on a shaft 32 of the furniture component 40 to be adjusted. An end switch receptacle 16 which is open on one end towards the wall 36 of the housing 30 is arranged inside the furniture drive 10 adjacent to an, in relation to the installation position, perpendicular the wall 36 of the housing 30. This end switch is provided in a conventional manner with tappets configured to switch the drive motor 11. A draw rod 18 is provided, which is spaced from the spindle 14 and has an inclined or stop face 22 at the end facing the end switch 17.

In the illustrated exemplary embodiment, the draw rod 18 is secured on the block-like slider 15. As a result, the draw rod 18 follows the movement of the spindle 14. FIG. 1 shows that the end switch 17 is adjusted so that the motor is switched off at a predetermined pivot angle of the articulated lever 23.

Figure 2:
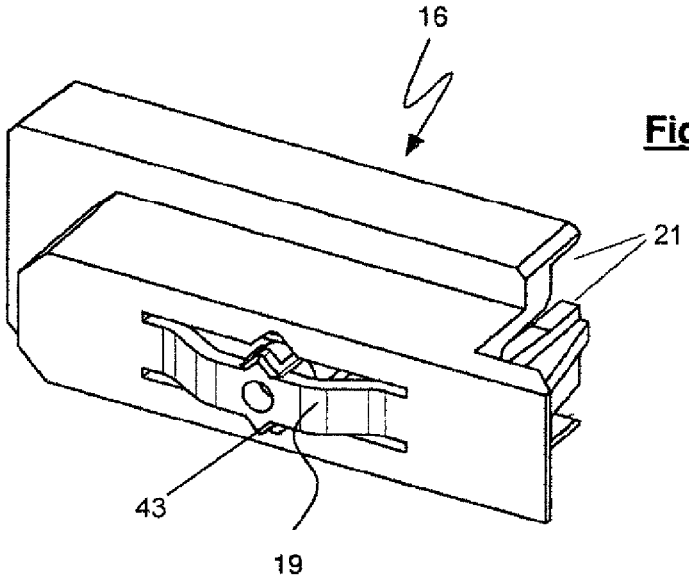

FIG. 2 shows the end switch receptacle 16 in isolation. The inserted end switch 17 is not visible. However, FIG. 2 clearly shows that the end switch receptacle 16 is provided on the side facing the housing wall 36 with a springy leaf 19, which can be deformed by an externally applied force so as to be positioned inside the housing 30. The springy leaf 19 is provided on both longitudinal sides with an arrow-shaped tip 43.

Figure 3:
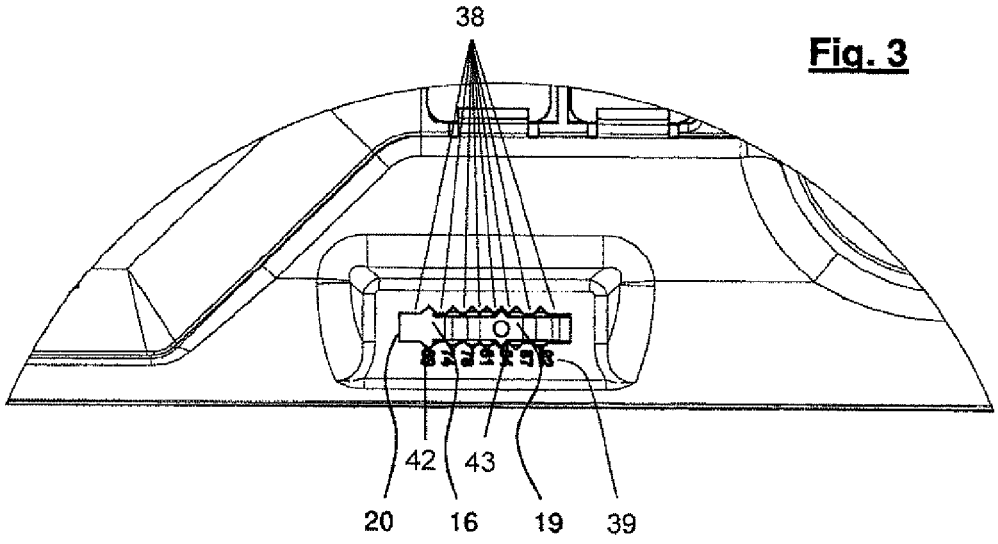

FIG. 3 shows that the housing 30 is provided with a slot 20 in which the springy leaf 19 is movably guided. The marginal regions 38 of the housing delimiting the slot 20 are provided with several triangular profiles 42, with which the arrow-shaped tip 43 of the springy strap 19 selectively engages. The housing is provided with a graduation 39 commensurate with the triangular profiles 42. The graduation 39 shows that in the illustrated exemplary embodiment the linear travel of the spindle 14 can be increased or decreased by 23 mm. A user is hence able to determine immediately, to which value he can change the travel of the spindle 14 after actuating the springy leaf 19.

Unlike in the illustrated embodiment, the draw rod 18 can also be directly attached on the spindle 14. Conversely, the draw rod 18 may also be configured as a telescope, with the extendable tube then following the movement of the spindle 14.

FIG. 2 also shows that the end switch receptacle 16 is provided on the side facing away from the springy leaf 19 with a guide groove 21 in which the draw rod 18 engages for guiding.

Figure 4:
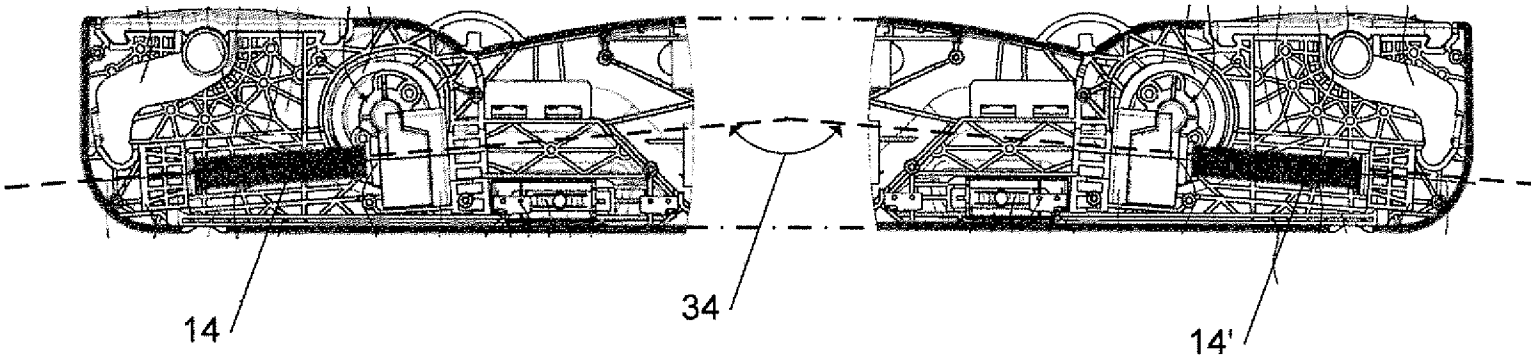

The invention is not limited to the illustrated exemplary embodiments. It is significant that a pressure block 15 is placed on the spindle 14, and that for optimal force transmission the longitudinal center axis 33 of spindle 14 is inclined with respect to the horizontal, so that at the beginning of an adjustment travel a force, which extends in the longitudinal direction 33 of the spindle 14, operates on the adjusting element 23. Likewise, as shown in FIG. 4, the longitudinal axis 33' of spindle 14' is also inclined with respect to the horizontal, with the longitudinal center axes 33, 33' enclosing an obtuse angle 34 therebetween. It is also significant that the rotation speed reduction gear 12 has a damping cover 36 for damping structure-borne noise.

The invention claimed is:

1. A dual electromotive furniture drive comprising:

a housing constructed in at least two sections and having U-shaped openings, shafts constructed for rotation relative to the housing and engaging with the U-shaped openings, the shafts operatively connected with at least one furniture component to be adjusted, at least one drive motor, a rotation speed reduction gear drive-coupled to the at least one drive motor, a first rotation-locked spindle defining a first center longitudinal axis and a second rotation-locked spindle defining a second center longitudinal axis, wherein the first and second center longitudinal axes enclose with each other an obtuse angle of less than 180° and are inclined relative to a horizontal, which defines an installation position of the dual furniture drive, said first and second rotation-locked spindles operatively connected to the rotation speed reduction gear for movement in a longitudinal direction, wherein at least the rotation speed reduction gear and the first and second spindles are arranged inside the housing, at least one end switch associated with each spindle for delimiting end positions of the respective spindle, a pressure piece arranged on a side of each spindle facing away from the rotation speed reduction gear, and an articulated lever fixedly mounted on a movable furniture component and operatively connected to the pressure piece, wherein each spindle and the pressure piece form a driven element, wherein at least one of the driven element and the housing comprise an adjusting device constructed as a housing-shaped end switch receptacle and configured to adjust a position of a switching threshold of the at least one end switch from outside the housing.

2. The dual electromotive furniture drive of claim 1, wherein the at least one end switch of each spindle is inserted in a respective housing-shaped end switch receptacle, and wherein for displacing the end switch receptacle, a wall of the housing associated with the end switch receptacle has a slot configured for securement of the end switch receptacle at different intervals with respect to the rotation speed reduction gear.

3. The dual electromotive furniture drive of claim 2, wherein the end switch receptacle includes a springy leaf or a springy tongue, wherein the springy leaf or the springy tongue has a counter-profile matching the profile of the marginal regions delimiting the slot.

4. The dual electromotive furniture drive of claim 1, comprising at least one draw rod arranged inside the housing and wherein the at least one draw rod is configured to follow the linear movement of a respective spindle.

5. The dual electromotive furniture drive of claim 4, wherein the at least one draw rod is secured on the pressure piece and is spaced from two walls of the housing.

6. The dual electromotive furniture drive of claim 2, further comprising a graduation arranged outside the housing on a side adjacent to the slot.

7. The dual electromotive furniture drive of claim 1, wherein the adjusting device is freely accessible from outside the housing or is covered by a cover element.

8. The dual electromotive furniture drive of claim 1, wherein a distance between a stop face of the adjusting device and the end switch is adjustable.

9. The dual electromotive furniture drive of claim 1, wherein the adjusting device is coupled with the at least one end switch such that the respective switching threshold of the at least one end switch is configured to be set at different intervals with respect to the rotation speed reduction gear.

* * * * *